US005377918A

United States Patent [19]

Garcia Pastor et al.

[11] Patent Number: 5,377,918

[45] Date of Patent: Jan. 3, 1995

[54] PULPERS FOR DISINTEGRATING CELLULOSE PULP

[75] Inventors: Daniel Garcia Pastor; Francisco Garcia Pastor, both of Valencia, Spain

[73] Assignee: D.G. International S.A., Bunol, Spain

[21] Appl. No.: 928,944

[22] Filed: Aug. 11, 1992

[30] Foreign Application Priority Data

Aug. 13, 1991 [ES] Spain ..... 9102241

[51] Int. Cl.[6] ..... B02C 23/22

[52] U.S. Cl. ..... 241/46.17; 241/60

[58] Field of Search ..... 241/46.17, 60, 46.11; 162/261

[56] References Cited

U.S. PATENT DOCUMENTS

| | | | |
|---|---|---|---|
| 2,137,388 | 11/1938 | Chapman | 241/60 |
| 2,448,038 | 8/1948 | Lykken et al. | 241/60 |
| 3,188,942 | 6/1965 | Wandel | 241/46.17 |
| 4,582,261 | 4/1986 | Perry | 241/46.17 |
| 4,884,756 | 12/1989 | Pearson | 241/60 |

OTHER PUBLICATIONS

Emerson-Triple Attack pp. 1-5, English Translation (date unknown).

Lamort Helico Pulpers—English translation (date unknown).

Black Clawson Hydrapulper—English translation (date unknown).

Jylhä-Pulper Brochure—(date unknown).

Tampella Pulpers Brochure-Bulletin 983-1989.

Voith Morden Brochure—Pulpers: Slush-Maker © and Hog (date unknown).

Hymac Pulpers Brochure—(date unknown).

*Primary Examiner*—Eugenia Jones

*Assistant Examiner*—Allan M. Schrock

*Attorney, Agent, or Firm*—Darby & Darby

[57] ABSTRACT

A pulper for the disintegration of cellulose pulp is disclosed in which a vessel containing bales of waste paper or pulp is of a spiral shape with a flat bottom, and a rotor is located in the center of the spiral. Impurities and foreign bodies are driven towards an Archimedes screw located at the outlet from the spiral, which removes them to the exterior. In this final pass this is washed by spray nozzles to recover the carried-over pulp.

8 Claims, 2 Drawing Sheets

PULPERS FOR DISINTEGRATING CELLULOSE PULP

FIELD OF THE INVENTION

This invention, as stated in this description, relates to improvements in pulpers for the disintegration of cellulose pulp and can be applied to different types of raw material.

It is applicable, according to size, to a great variety of forms of production, achieving uniform disintegration of the pulp, with continuous separation of impurities as a result of its spiral shape, and pulp recovery by continuous washing of the material extracted by the Archimedes screw.

BACKGROUND OF THE INVENTION

In the present state of the art there is a great variety of pulp disintegrators, which include those of the vertical type, with the rotor located in the base of the vat (traditional rotor type), spiral and other types, cylindrical or polygonal tanks, and others of a high density inclined type or with a lateral feed.

In all these disintegration is brought about by the motion of the rotor which destroys the bales of waste paper or pulp and also sets up strong turbulence in this zone. Deflector plates slow the pulp down, returning the mass again towards the central rotor.

There are also different systems for the extraction of impurities on the market. The most common are those using endless bands or chains with buckets. These arrangements are restricted by the size of the pulper, the concentration of the pulp, the difficulty of handling it, their high energy consumption and their low efficiency.

This type of vertical pulper with a tank which is spiral in plan solves various problems which arise in pulp preparation.

When recycled paper is used as a raw material this generally contains a large quantity of solid impurities. These foreign bodies are concentrated in the vortex created by the rotor and often obstruct it in such a way that it losses all its disintegrating capacity. This gives rise to long down times in paper production because the rotor has to be cleaned and the system adjusted, which incurs a high time cost and unevenness in quality.

Likewise in pulpers in which the rotor is central, a central vortex forms above the rotor and the remainder of the material rotates in a mass around it, so a large part of the power consumed is converted into rotation of the whole mass and not into disintegration of the pulp.

With this innovative design of a spiral shaped pulper tank large impurities are driven along the hydraulic path defined by the spiral to the Archimedes screw, which extracts them, while negative pressure is produced in such a way that the mass does not gyrate around the rotor, compelling it to pass beneath the disintegrating rotor, with the appearance of hydraulic shear forces which favour a gentle cutting process, which is very useful with recovered fibres because in this way they are not shortened. Likewise, expulsion of pulp carried over by the impurities to the exterior is avoided by the continuous washing applied to the Archimedes screw and the material which it carries, and the recovery which takes place at the base of the screw on the pulper side.

Maintenance is simple because the rotor and the driving mechanism can be removed via the interior of the, tank. The impurity extraction area is easily cleaned and easy of access for repair.

The equipment consists of the following parts:

- A cutting rotor with knives located in the base of the tank.
- A tank of spiral shape, open at the top and constructed of sheet metal with a flat base.
- An Archimedes screw for the extraction of impurities and foreign bodies.
- A motor and reduction gear to drive the Archimedes screw
- A motor and reduction gear to drive the cutting rotor.
- A panel for discharging and cleaning the Archimedes screw.
- Supporting columns for the equipment.

BRIEF DESCRIPTION OF THE DRAWINGS

The appended drawings show the various details of the equipment.

DESCRIPTION OF A PREFERRED EMBODIMENT

Figure 1:
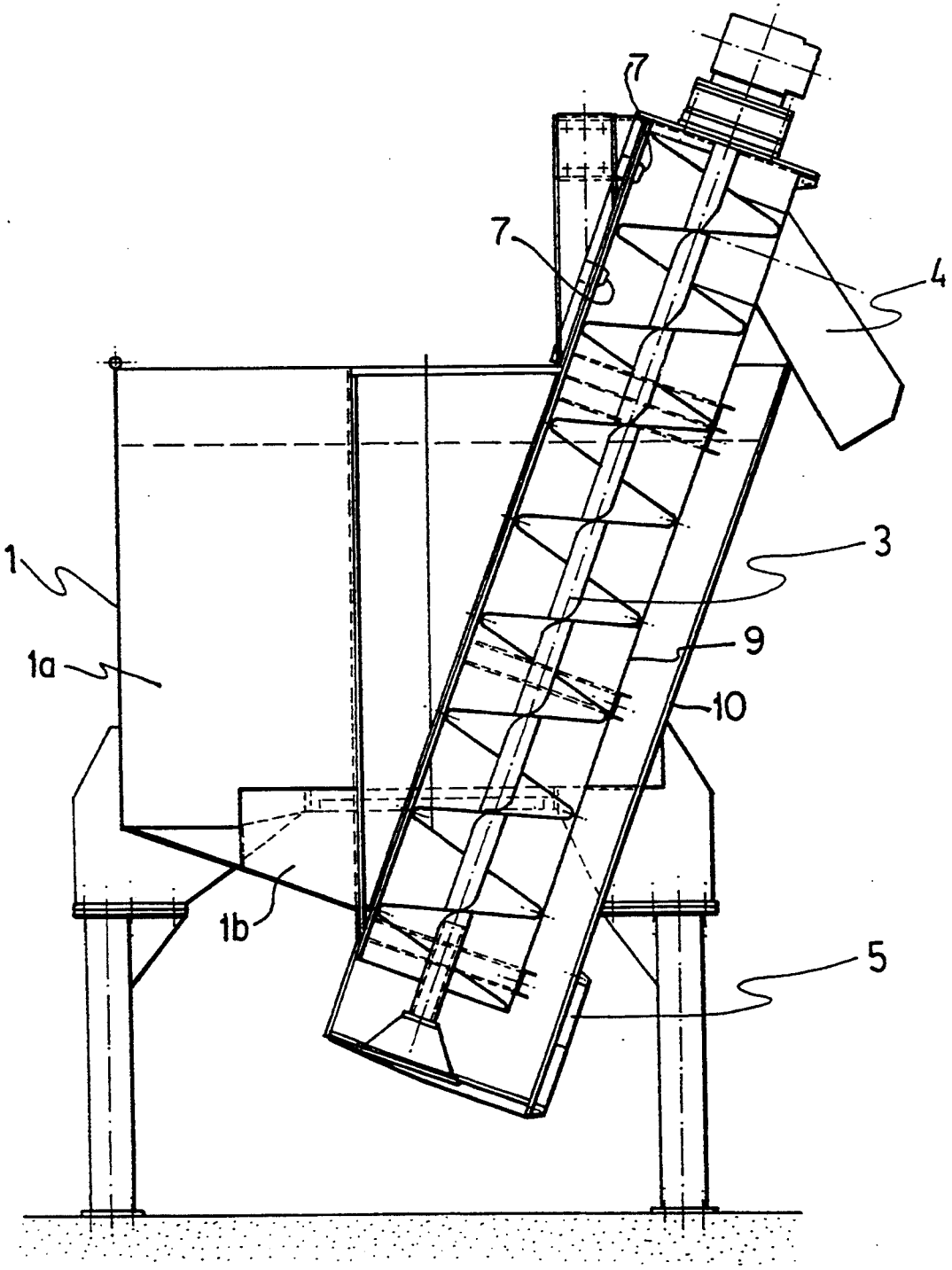
FIG. 1—A longitudinal cross-section through the pulper in elevation.

The construction of the pulper can be seen from the drawings mentioned.

Figure 2:
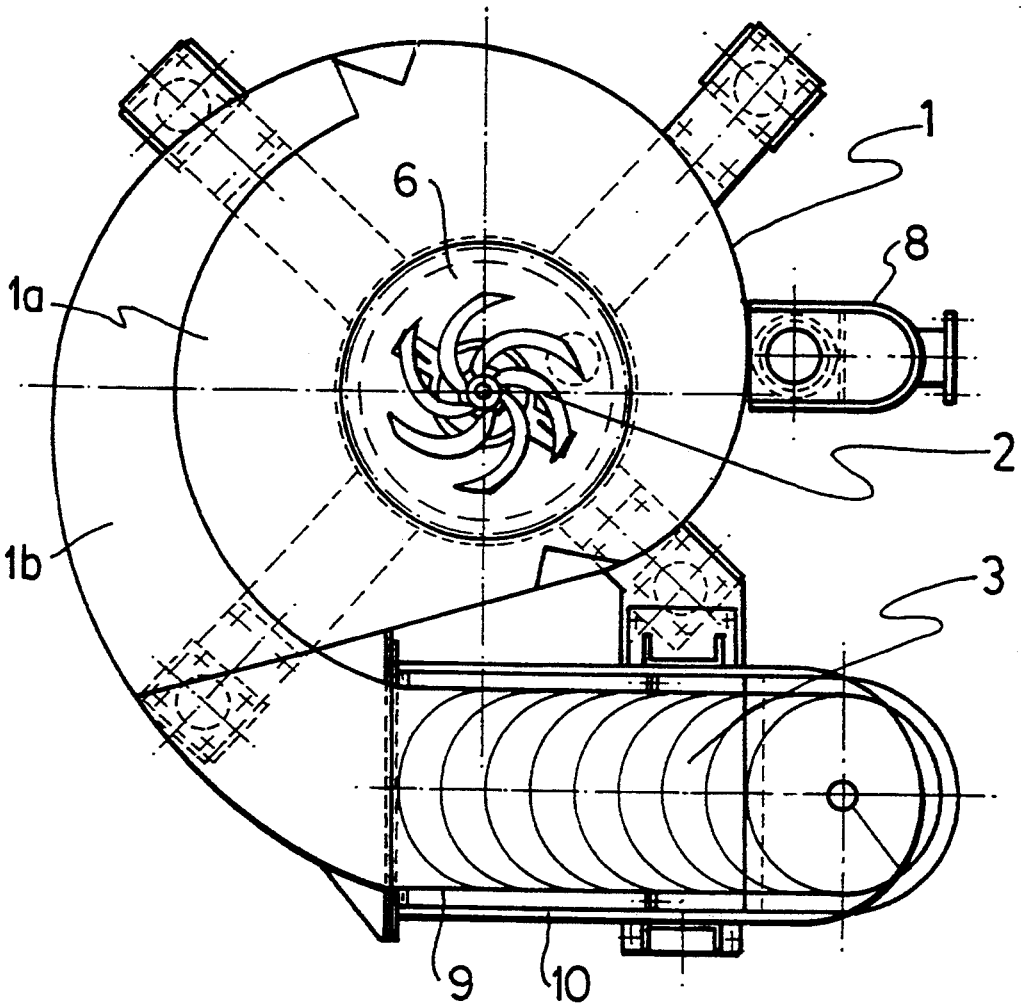
FIG. 2—A plan of the equipment showing the location and shape of the rotor.

It comprises a tank of spiral shape with a flat bottom (1), made of sheet metal. Its design brings about total disintegration of recovered paper or cellulose up to a density of 9%. As seen in FIG. 2, the tank includes an inner peripheral wall and an outer peripheral wall, forming a central area (1*a*) and a passage (1*b*) formed between the inner and outer peripheral walls.

The rotor (2) located in the base of the tank at the centre of the spiral described causes disintegration of the pulp, rather than cutting of the fibres because hydraulic shear forces predominate.

The pulp is collected from the bottom part of the pulper (at 8, FIG. 2), via the grating placed beneath the rotor (2.)

The diameter of the hole allows the pulp to pass and the blades of the rotor itself prevent it from being obstructed. That is, the diameters of the holes of the perforated grating (6) or screen allow the pulp to pass and allow the blades of the rotor (2) to prevent said grating from become obstructed.

The rotor (2) is constructed of a chromium steel alloy which is subjected to heat treatment which makes it highly abrasion-resistant.

All the rotor mechanism has a micrometric control system to maintain an adequate distance between the rotor and the perforated grid.

Impurities and solid foreign bodies are expelled via the Archimedes screw (3) located at the outlet from the spiral (wide portion) and with a suitable inclination with respect to the horizontal to effect discharge. The worm of the Archimedes screw is constructed of sheet metal.

When a solid foreign body is introduced into the pulper this follows the path described by the spiral defined by the walls and base of the tank (1), so that it falls into the extraction area.

Through its movement the Archimedes screw (3) picks up this solid lifting it to the discharge outlet (4.) As it passes towards the exterior sprays (7) wash it so that any pulp which is carried over to the exterior together with the impurities is recovered, avoiding unnecessary losses of material.

This wash water together with the pulp is recovered via a perforated grid (9) which surrounds at least the bottom of the Archimedes screw, and because of its inclination falls via gravity into the pulper again taking part in the process of disintegrating and diluting the cellulose pulp. Any loss of pulp in the disintegration process is avoided in this way. The Archimedes screw (3) is easily cleaned or repaired via the panel (5) in the bottom part of the shell (10). All the power consumed is taken up in the disintegration process, as a result of which, through the spiral shape of the pulper, the entire mass is directed towards the position so that no dead spots can occur, with rotary movement of the mass around the vortex set up by the rotor blades, which gives rise to a high energy cost in conventional pulpers.

Likewise the system for the extraction of impurities using an Archimedes screw has minimum energy consumption, much less than any other system currently in existence. The equipment described here is very robust, with a capacity which can be adjusted to different forms of putput, and is easy to install and maintain.

It may work continuously or discontinuously, adjusting to different types and qualities of raw material and types of pulp and dilution.

The rotor and the Archimedes screw are driven by two independent motor and reduction gear units in accordance with the individual requirements or needs of each.

Fundamental features of the innovation which distinguish its operation from other disintegrators available on the market are:

The continuous extraction of impurities and extraneous solids with a system based on an Archimedes screw, which is a new and effective arrangement.

Recovery of pulp carried-over by the impurities ensuring a better yield from the raw material, thus making it an ecological pulper.

Frugal energy consumption, both in the extraction system and in disintegration, due to the design of the pulper.

Easy cleaning and maintenance.

Easy change of raw materials on changing grades.

Flexibility in methods of working.

We claim:

1. A pulper for recycling cellulose pulp from waste paper, comprising:

a vessel into which said waste paper is fed;

a rotor provided within said vessel to disintegrate said waste paper into a pulp;

a screen having first openings for allowing passage of a portion of said pulp, said screen located beneath said rotor in the bottom of said vessel;

first evacuating means for evacuating a portion of said pulp to an archimedes screw housed within a first cylindrical housing, said first housing being surrounded by a second cylindrical housing, said first and second housings each having a first outlet at a top portion thereof, a bottom end portion of said first housing being connected to said first evacuating means;

means to inject water onto said screw;

wherein said vessel has a spiral cross section at least at a bottom portion thereof;

wherein said first cylindrical housing has second openings having diameters of predetermined size that are sufficiently wide to allow passage of readily recycled paper pulp but too narrow to allow passage of larger solids, whereby said larger solids are carried by said screw to said first outlets;

second evacuating means located beneath said screen for collecting said recycled paper pulp.

2. A pulper as in claim 1, wherein said vessel has an inner peripheral wall and an outer peripheral wall, said rotor being located within the inner peripheral wall of said spiral-cross sectioned vessel but eccentrically in respect of the outer peripheral wall of said vessel so that action of said rotor provides a rotational movement of said waste paper into the direction of said first evacuating means and provides hydraulic shearing stresses acting on said waste paper.

3. A pulper as in claim 2 wherein said first evacuating means comprises a passage formed between an outer surface of a portion of said inner peripheral wall and an inner surface of a corresponding portion of said outer peripheral wall, so that the portion of the pulp which has not been evacuated through said second evacuating means is lead through said first evacuating means to said screw.

4. A pulper as in claim 3 wherein said first and said second housings are disposed in a position that is inclined with respect to a vertical position.

5. A pulper as in claim 4 wherein said screw and said first housing are disposed eccentrically from the central longitudinal axis of said second housing in a position near to an upper wall portion of said second housing.

6. A pulper as in claim 1 wherein said paper pulp that has passed through said second openings falls on an inner wall surface of said second housing, slides to a bottom portion of said second housing and is from there added to the paper which has not entered said first evacuation means.

7. A pulper as in claim 6 wherein said first housing does not extend to a bottom end of said second housing.

8. A pulper as in claim 7 wherein said paper that does not pass through said first evacuating means is returned to the tank.

* * * * *